US006286426B1

(12) United States Patent
Bööse

(10) Patent No.: US 6,286,426 B1
(45) Date of Patent: Sep. 11, 2001

(54) DOCTOR BLADES

(76) Inventor: Åke Bööse, Tryffelslingan 16, S-181 57 Lidingo (SE)

( * ) Notice: Subject to any disclaimer, the term of this patent is extended or adjusted under 35 U.S.C. 154(b) by 0 days.

(21) Appl. No.: 09/587,955

(22) Filed: Jun. 6, 2000

(51) Int. Cl.[7] ..... B41F 9/10
(52) U.S. Cl. ..... 101/169; 15/256.51
(58) Field of Search ..... 101/154, 155, 101/157, 167, 169, 161, 423; 15/256.5, 256.51

(56) References Cited

U.S. PATENT DOCUMENTS

| | | | |
|---|---|---|---|
| 2,007,418 | 7/1935 | Akre . | |
| 3,986,453 | * 10/1976 | Boose | 101/169 |
| 4,359,799 | 11/1982 | Bööse . | |

FOREIGN PATENT DOCUMENTS 1 507 825 4/1978 (GB) .

* cited by examiner

*Primary Examiner*—John S. Hilten
*Assistant Examiner*—Kevin D. Williams
(74) *Attorney, Agent, or Firm*—Flynn, Thiel, Boutell & Tanis, P.C.

(57) ABSTRACT

A doctor blade assembly having a flexible doctor blade holder consisting of a wider flexible carrier plate by means of which the assembly is mounted, a narrower flexible presser plate and a flexible wedge member held together with a plurality of ties. A replaceable doctor blade is formed of a strip of uniform thickness and is clamped together with a narrower back-up strip securely but releasably between the forward edges of the carrier plate and the presser plate. The wedge member is inserted between the rear edge of the presser plate and the carrier plate. The wedge member has a rear portion including a flange projecting away from the carrier plate both to permit manual manipulation of the wedge member and to divert liquid, such as ink, away from the carrier plate.

6 Claims, 2 Drawing Sheets

DOCTOR BLADES

FIELD OF THE INVENTION

The present invention relates to doctor blades, more particularly but not exclusively for stripping excess ink from a rotating printing roll in the surface of which there are arranged depressions for filling with printing ink. The doctor blade is attached to a holder carried by an adjustable apparatus, which determines the force with which the doctoring edge of the blade lies against the printing roll. Such blades are exposed to wear and must be changed after a period of use.

A conventional doctor blade consists of a strip, which is formed along its length with a thinner forward portion and a thicker rear portion. The free edge of the thinner portion is intended for use as stripping edge, while the thicker portion is intended for clamping in a standard type of blade holder for the printing machinery in question. The advantage of the thin portion of more or less even thickness is that the wear on it can take place without the wear causing any unacceptable alteration of the profile of the scraping or doctoring edge engaging the printing roll.

PRIOR ART

U.S. Pat. No. 4,359,799 discloses the use of a replaceable thin and narrow strip as a doctor blade. The strip is clamped in a doctor blade holder which is relatively flexible transversely and longitudinally.

The longitudinal flexibility is however reduced when insoluble dried or solidified ink accumulates in the interior of the holder, for instance with water-based inks.

This solidified ink sometimes makes changing of the strip extremely difficult and can even prevent a proper installation of a new strip. Further, such a doctor blade will be wavy and make doctoring unsatisfactorily, resulting in poor print quality. A certain amount of waviness of the doctor blade can be accepted, but a higher blade pressure against the printing roll must be applied. As a result the doctor blade life will be short.

In certain types of printing machines, the design requires a kind of sealing-blade to prevent the ink flow underneath the doctor blade from running too far into the mechanism of the doctor blade holder system. This stationary seal or sealing blade is supposed to be ink-tight against the transversely oscillating doctor blade. Too often this seal leaks and allows ink to flow out onto the floor in the printing works. As a result, the printing press must be stopped and the seal repaired. Even minor leakage, which does not require immediate attention will still result in loss of printing ink and a poor work environment.

SUMMARY OF THE INVENTION

A doctor blade assembly has a flexible doctor blade holder consisting of a wider flexible carrier plate by means of which the assembly is mounted, a narrower flexible presser plate and a flexible wedge member held together with a plurality of ties. A replaceable doctor blade is formed by a strip of uniform thickness and is clamped together with a narrower back-up strip securely but releasably between the forward edges of the carrier plate and the presser plate, the wedge member being inserted between the rear edge of the presser plate and the carrier plate. The wedge member has a rear portion including a flange projecting away from the carrier plate both to permit manual manipulation of the wedge member and to divert liquid, such as ink, away from the carrier plate.

BRIEF DESCRIPTION OF THE DRAWINGS

A preferred embodiment of the invention will now be described by way of example with reference to the accompanying drawings, in which.

DETAILED DESCRIPTION

Figure 1:
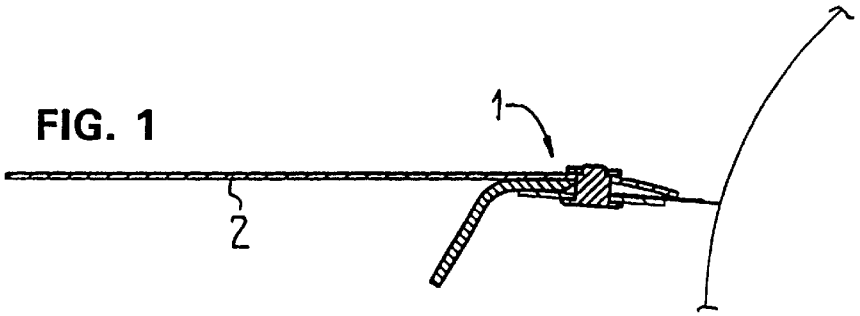
FIG. 1 is a view in cross section of the complete blade holder with doctor blades installed as taken along line 1—1 in FIG. 4.
Figure 2:
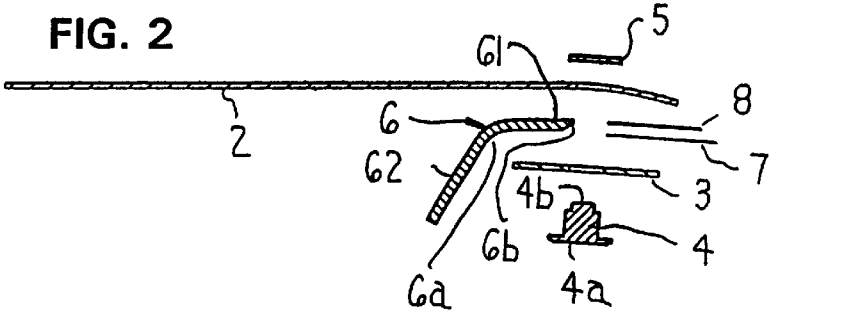
FIG. 2 is an exploded view in cross section, through the complete blade holder shown in FIG. 1, FIGS. 3 and 3A are cross-sectional views through the blade holder, with the wedge member and the blades removed and the holder ready for cleaning and/or insertion of blades and the wedge member.
Figure 4:
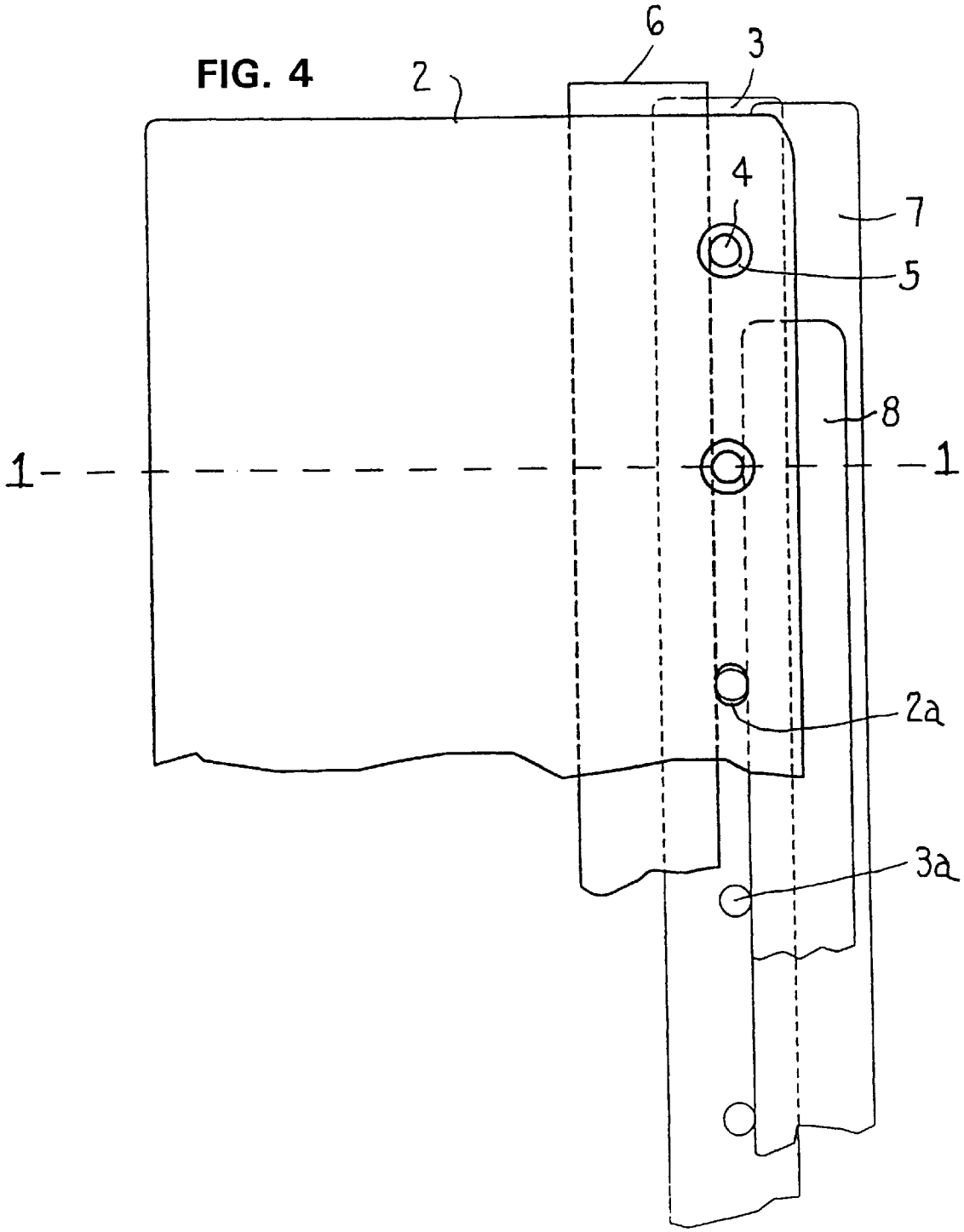
FIG. 4 is a fragmentary plan view of the complete blade holder with doctor blades installed shown in FIG. 1.

The doctor blade assembly shown in FIGS. 1, 2 and 4 has a flexible doctor blade holder 1 consisting of a wider flexible carrier plate 2, a narrower flexible presser plate 3 and a flexible wedge member 6 held together with a plurality of ties 4. The doctor blade holder 1 clamps a doctor blade 7 with its back-up strip 8 securely but releasably.

The doctor blade 7 is formed by a length of thin steel strip cut from stock of uniform thickness and width, the thickness of the strip being in the range 0.05–0.20 mm. The doctor blade 7 is supported by the backup strip 8 which also is a thin steel strip of uniform thickness but is narrower than the doctor blade 7. The back-up blade 8 has normally a width of 1 to 2 mm less than the doctor blade 7 and a thickness in the range of 0.1 to 0.20 mm.

Both blades 7, 8 are resiliently clamped, as shown in FIGS. 1 and 4, in the flexible doctor blade holder 1. This holder consists of a wider flexible carrier plate 2, which is clampable or fixable in a conventional solid metal holder, and a narrower flexible presser plate 3, which is disposed with its front edge almost flush with, or at a small distance from, the front edge of the wider plate 2. Both plates 2 and 3 are of spring steel 0.5 mm thick or less. As shown in FIG. 2 the arched wider plate 2 is transversely curved but can also be formed by bending to a corresponding degree, resulting in each case in two flat portions at an obtuse angle to each other.

Figure 3:
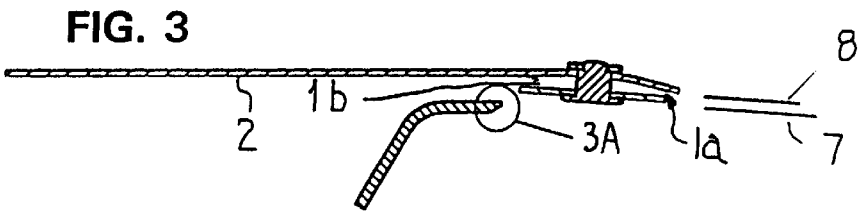
Figure 3A:
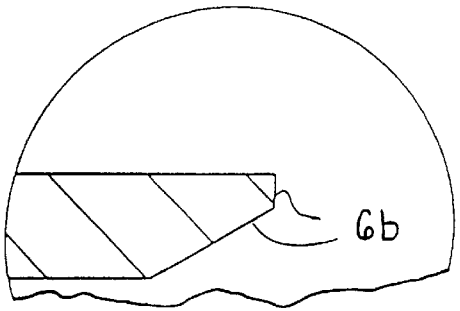

As shown in FIGS. 2, 3 and 4, the wedge member 6 is formed from a continuous length of flexible plastics material 0.5 to 2-mm thick angles at 6*a* to form a wedge portion 61 and a downwardly and rearwardly sloping rear flange 62. The front edge of the wedge portion 61 is chamfered at 6*b* to assist insertion of the wedge portion between the rear of the presser plate 3 and the underside of the carrier plate 2.

The plates 2 and 3 are held in position by a plurality of ties 4 arranged in a straight row, and each having a flange 4*a* at one end in the shape of a bolt head and a reduced-diameter portion 4*b* at the other end which extends through a washer 5 and is rivetted over.

The free length of the ties 4 between the two clamping surfaces presented respectively by the flange 4*a* and the washer 5, the curvature of the wider carrier plate 2 and the thickness of the wedge member 6 are so selected relative to each other that the desired clamping pressure is obtained between the front end portions 1*a* of the plates 2 and 3.

The round holes 3*a* of the narrower presser plate 3, and the elongated holes 2*a* of the wider carrier plate 2 through which the ties 4 pass, accurately fit the ties transversely and lie with their extended longer dimension in a straight row parallel to the edges of the plate 2. This permits convenient insertion of the blades 7, 8 to an accurately determined position by first the back-up blade 8 being inserted up to engagement with the ties 4 and then the doctor blade 7 being inserted up to engagement with the ties 4, which thus also serve as stops for the two blades 7, 8. The wedge portion 61 of the wedge member 6 is then inserted between the rear edge of the presser plate 3 and the underside of the carrier plate 2 to tension the presser plate to generate the required clamping forces on the blades 7 and 8. The wedge member is pushed forwards until its front edge engages the stops again formed by the ties 4 on their sides opposite to the blades 7 and 8. The chamfer 6*b* simplifies the insertion of the wedge portion 61 between the two plates 2, 3.

When the angled wedge 6 is pulled out of its position in the blade holder 1 and the blades 7 and 8 are removed, as shown in FIG. 3, the interior 1*a*, 1*b* of the blade holder 1 is accessible for cleaning, mechanically and/or chemically.

These operations are facilitated by the rear flange 62 which forms a convenient grip for manual manipulation.

A second important feature of the rear flange 62 is the function of diverting the ink that is being wiped from the printing roll, away from the carrier plate 2. As a result the ink falls down in a desired area of the printing unit and consequently not into the doctor blade holder mechanism of the print unit.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A doctor blade assembly comprising:

a resiliently flexible carrier plate, said carrier plate having a rearward mounting portion by which it is adapted to be mounted and a forward portion, a presser plate extending along said carrier plate adjacent said forward portion of said carrier plate, said presser plate having a forward edge and a rearward edge, a resilient flexible doctor blade strip of constant thickness clamped between said forward portion of said carrier plate and said presser plate, a row of ties passing through apertures in said presser plate and said forward portion of said carrier plate, and a wedge member removably interposed between said rearward edge of said presser plate and said carrier plate, said wedge member having a forward edge and a rearward portion, said forward edge of said wedge member being chamfered.

2. The doctor blade assembly of claim 1 in which said rearward portion of said wedge member has manually engageable means extending away from said carrrier plate.

3. The doctor blade assembly of claim 2 in which said manually engageable means of said wedge member is formed by a flange projecting away from the carrier plate in a rearward direction.

4. The doctor blade assembly of claim 1 in which said forward portion of said carrier plate extends at an obtuse angle to that portion of the carrier plate which is in contact with said wedge member.

5. The doctor blade assembly of claim 4 in which said rearward portion of said wedge member has manually engageable means extending away from said carrier plate.

6. The doctor blade assembly of claim 5 in which said manually engageable means of said wedge member is formed by a flange projecting away from the carrier plate in a rearward direction.

* * * * *